US007443231B2

(12) United States Patent
Chang

(10) Patent No.: US 7,443,231 B2
(45) Date of Patent: Oct. 28, 2008

(54) LOW POWER REFERENCE VOLTAGE CIRCUIT

(75) Inventor: Chien-Yi Chang, Hsinchu (TW)

(73) Assignee: Elite Semiconductor Memory Technology Inc. (TW)

( * ) Notice: Subject to any disclaimer, the term of this patent is extended or adjusted under 35 U.S.C. 154(b) by 162 days.

(21) Appl. No.: 11/463,420

(22) Filed: Aug. 9, 2006

(65) Prior Publication Data

US 2008/0036530 A1 Feb. 14, 2008

(51) Int. Cl.
*G05F 1/10* (2006.01)

(52) U.S. Cl. ..... 327/539; 327/530

(58) Field of Classification Search ..... 327/538–541, 327/530, 543

See application file for complete search history.

(56) References Cited

U.S. PATENT DOCUMENTS 5,220,273 A 6/1993 Mao
5,283,762 A * 2/1994 Fujishima ..... 365/189.09
5,909,142 A * 6/1999 Kawasaki et al. ..... 327/543
6,111,394 A * 8/2000 Casper ..... 323/273
6,339,357 B1 * 1/2002 Yamasaki et al. ..... 327/538
6,788,131 B1 * 9/2004 Huang ..... 327/539
6,859,067 B2 * 2/2005 Yamamoto ..... 326/80
7,218,168 B1 * 5/2007 Rahman ..... 327/540
7,230,473 B2 * 6/2007 Tadeparthy et al. ..... 327/539

* cited by examiner

*Primary Examiner*—Lincoln Donovan
*Assistant Examiner*—Hai L. Nguyen
(74) *Attorney, Agent, or Firm*—Duane Morris LLP

(57) ABSTRACT

A circuit for providing a reference voltage includes a bandgap reference circuit, the bandgap reference circuit providing a first reference voltage and a data storage. The data storage stores a digital value corresponding to the first reference voltage. A digital to analog converter is coupled to the data storage for providing a second reference voltage corresponding to the digital value. The circuit also includes an output switch circuit responsive to at least one control signal, the output switch circuit providing either the first reference voltage or the second reference voltage to an output node responsive to the control signal.

17 Claims, 5 Drawing Sheets

LOW POWER REFERENCE VOLTAGE CIRCUIT

FIELD OF THE INVENTION

The present invention relates to circuits and methods of for providing a reference voltage.

BACKGROUND OF THE INVENTION

References voltages used in circuits such as memories should be stable and immune from temperature and power supply variations since overall circuit performance is negatively effected by any variation in the reference voltage. Therefore, a bandgap reference voltage generator is often employed to generate an internal voltage reference for integrated circuits.

The operating principle behind bandgap reference voltage generation is familiar to those in the art but is briefly described below. A bandgap reference voltage generator is a voltage reference circuit widely used in integrated circuits, usually with an output voltage around 1.25 V, close to the theoretical bandgap of silicon at 0 K. The voltage difference between two unequal size diodes is used to generate a proportional to absolute temperature (PTAT) current in a first resistor. This current is used to generate a PTAT voltage in a second resistor, which is added to the voltage of a diode, in some implementations. If the ratio between the first and second resistor is chosen properly, the first order effects of the temperature dependency of the diode voltage and the PTAT voltage will be canceled out. The resulting voltage is around 1.25V. The voltage change over the operating temperature of typical integrated circuits is on the order of a few millivolts.

Examples of prior art bandgap circuits are provided in U.S. Pat. No. 6,788,131 to Huang and U.S. Pat. No. 5,200,273 to Mao, the entirety of which are hereby incorporated by reference herein.

In summary, the output voltage is made substantially invariant with regard to temperature by taking a weighted sum of a voltage that has a negative temperature coefficient (viz the voltage across the PN junction) and one that has a positive temperature coefficient. However, the bandgap reference voltage generator is always "on" or "enabled" in order to provide the reference voltage for the integrated circuit, thereby increasing the power consumption of the integrated circuit. Lower power reference voltage generation circuits and methods, therefore, are desired.

SUMMARY OF THE INVENTION

A circuit for providing a reference voltage includes a bandgap reference circuit, the bandgap reference circuit providing a first reference voltage and a data storage. The data storage stores a digital value corresponding to the first reference voltage. A digital to analog converter is coupled to the data storage for providing a second reference voltage corresponding to the digital value. The circuit also includes an output switch circuit responsive to at least one control signal, the output switch circuit providing either the first reference voltage or the second reference voltage to an output node responsive to the control signal.

The above and other features of the present invention will be better understood from the following detailed description of the preferred embodiments of the invention that is provided in connection with the accompanying drawings.

BRIEF DESCRIPTION OF THE DRAWINGS

The accompanying drawings illustrate preferred embodiments of the invention, as well as other information pertinent to the disclosure, in which.

DETAILED DESCRIPTION

Figure 1:
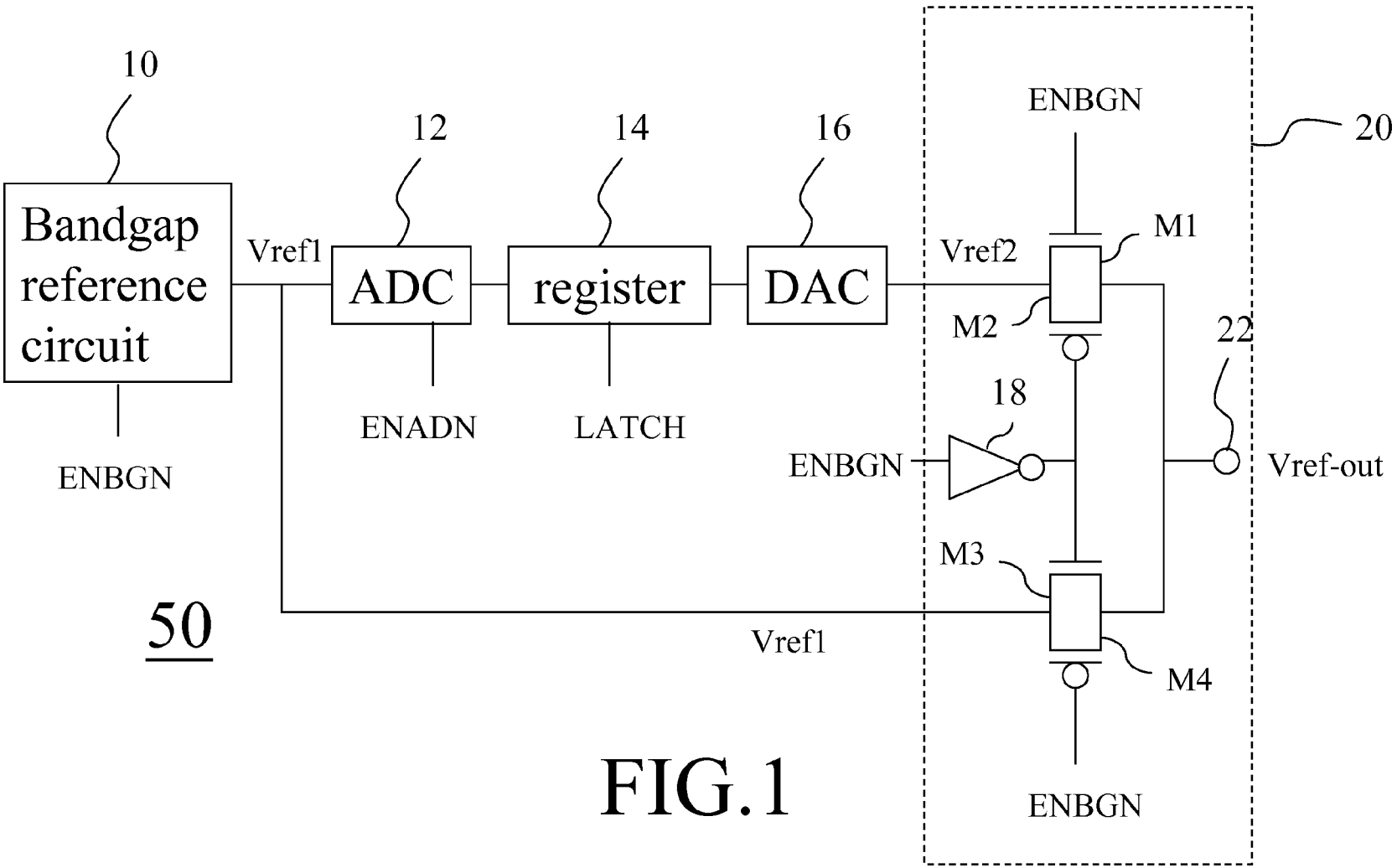
FIG. 1 is a circuit diagram of a low power reference voltage generation circuit according to the present invention.

This description of the exemplary embodiments is intended to be read in connection with the accompanying drawings, which are to be considered part of the entire written description. In the description, relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

FIG. 1 is a circuit diagram of an exemplary low power reference voltage generation circuit 50 in accordance with one embodiment of the present invention. As described hereafter, the circuit 50 conserves power by turning off the bandgap reference circuit 10 during a portion of the operating period of the circuit 50.

The low power reference circuit 50 includes a conventional bandgap reference circuit 10. The details of the bandgap reference circuit 10 do not form a part of the present invention. The structure and operation of the bandgap reference circuit 10 are familiar to those in the art and are not repeated herein. Examples of a bandgap reference circuits are described in the "Background of the Invention" section and incorporated herein. Regardless of its configuration, the bandgap reference circuit 10 provides a first temperature and/or power supply stable reference voltage Vref1 at its output. The bandgap reference circuit 10 is responsive to bandgap enable/disable control signal ENBGN, i.e., when signal ENBGN is high, the bandgap reference circuit 10 is disabled, i.e., "off," and when ENBGN is low, the bandgap reference circuit 10 is operational, i.e., "on," and provides Vref1 at its output. When ENADN is high, the analog to digital converter (labeled "ADC") 12 is disabled; and when ENADN is low, the analog to digital converter (labeled "ADC") 12 is operational.

The bandgap reference voltage Vref1 is provided to an analog to digital converter (labeled "ADC") 12 for conversion to a digital signal representative of the value of Vref1. Numerous designs for ADCs are familiar to those in the art and need not be detailed herein. The conversion sensitivity or resolution can be selected depending on the required tolerance for the circuit 50, with the understanding that increased resolution increases device complexity. In one embodiment, the ADC 12 is a four bit converter.

The digital output of ADC 12 is provided to a data storage, such as data register 14, for storage. The output of the ADC 12 is latched to the register 14 in response to control signal LATCH. The stored signal is available to digital to analog converter (labeled "DAC") 16. DAC 16 provides a second reference voltage that is an analog reference voltage corresponding to the digital value stored in register 14. As with the bandgap reference circuit 10, the DAC 16 is also substantially immune to temperature and power supply changes. For example, if the output analog voltage of the DAC 16 is generated by a voltage divider from a stable power supply VDD, it would be immune from temperature and power supply changes. Assume Vref2 is equal to VDD*{[R1*(1+aT)]/[R2* (1+aT)]}, where R1 and R2 are resistance values in the divider, "a" is a temperature coefficient, and "T" is temperature. The values of R1 and R2 can be selected so that the value of Vref2 is approximately equal to VDD*(R1/R2) despite temperature changes. VDD should be substantially fixed after and initial power up period.

The circuit 50 includes an output switching stage 20 which operates to provide an output reference voltage Vref-out that is substantially immune to temperature and operating voltage fluctuations. As discussed hereafter, Vref is equal to Vref1 when ENBGN is low and is equal to Vref2, provided from DAC 16, when ENBGN is high.

Turning to output stage 20, the output stage is essentially a 2 to 1 switch that passes Vref1 to output node 22 when the bandgap reference circuit 10 is "on" and passes Vref2 to the output node 22 when the output of the bandgap reference circuit 10 is no longer available, i.e., when the bandgap reference circuit 10 is "off." The output stage 20 includes four MOS transistor M1-M4, configured as two CMOS pass gates. Transistors M1 and M2 are coupled in parallel, with a first terminal of each coupled together to the output of DAC 16 and a second terminal of each coupled together to the output node 22 of the circuit 50. The gate terminal of NMOS M1 is coupled to control signal ENBGN, and the gate terminal of PMOS M2 is coupled to /ENBGN, via inverter 18. Collectively, transistors M1 and M2 serve as a switch that passes voltage Vref2 to the output node 22 when ENBGN is high. Though the switches are shown as CMOS switches, other switching devices may be used, such as individual NMOS or PMOS devices, pairs of NMOS or PMOS devices, or the like, for receiving control signal ENBGN or /ENBGN as appropriate.

Transistors M3 and M4 are coupled in parallel, with a first terminal of each coupled together to the output of bandgap reference circuit 10, i.e., to Vref1, and a second terminal of each coupled together to the output node 22 of the circuit 50. The gate terminal of NMOS M3 is coupled to /ENBGN, and the gate terminal of PMOS M4 is coupled to control signal ENBGN. Collectively, transistors M1 and M2 serve as a switch that passes voltage Vref1 to the output node 22 when ENBGN is low.

Figure 2:
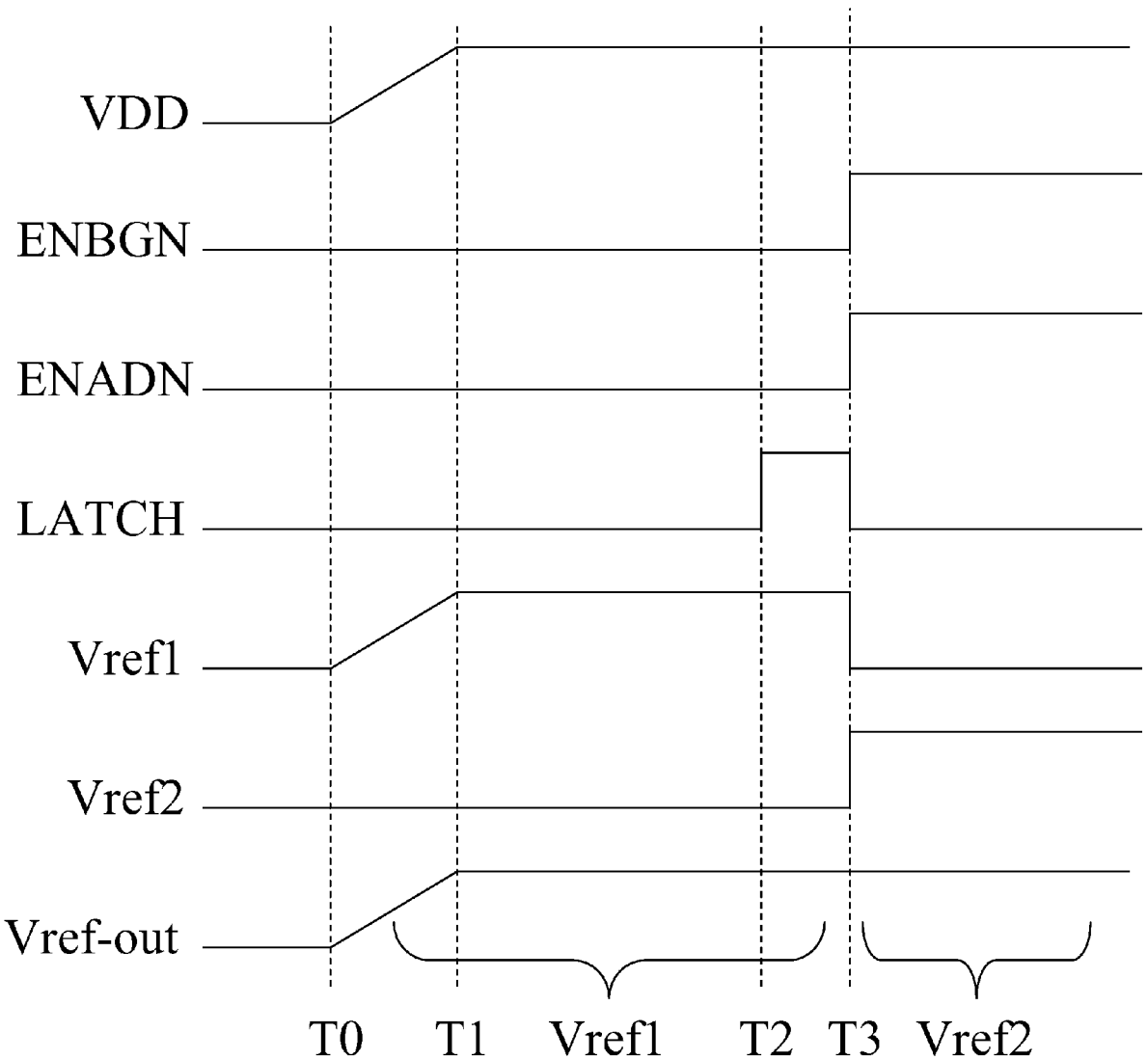
FIG. 2 is a timing diagram of control signals illustrated in FIG. 1.

FIG. 2 is a timing diagram illustrating an exemplary embodiment of the timing of the various control signals in the circuit 50 of FIG. 1. At time T0, the circuit 50 is turned on. As those in the art understood, it takes some time period for the supply voltage VDD to reach a stable level, i.e., to reach steady state. During time T0 to time T1, VDD raises to this steady state voltage level. During this time, control signals ENBGN and ENADN are low. The output node 22 is coupled to the output of the bandgap reference circuit 10, which is enabled, through CMOS switch M3/M4. At time T1, VDD reaches its steady state voltage level. Between time T1 to time T2, when VDD is at its desired voltage level, ENBGN and ENADN remain low, bandgap reference circuit 10 and ADC 12 are on. Voltage Vref1 is generated by bandgap reference circuit 10 and provided to the transistor switch combination M3/M4. Transistor switches M3 and M4 are both on, passing Vref1 to output node 22.

At time T2, i.e., some time after VDD becomes stable and thus Vref1 has reached its steady state level, control signal LATCH goes high and is provided to register 14, which latches the data available from ADC 12 for storage in register 14. The stored data are then available to DAC 16 for conversion to an analog voltage level, i.e., for generation of voltage Vref2. At time T3, Vref2 is available from DAC 16 and signal LATCH goes low. Signals ENBGN and ENADN go high. With ENBGN high and ENADN high, the bandgap reference circuit 10 and the ADC circuit 12 are turned off. Switch transistor M3 and M4 are turned off, disconnecting the output of the bandgap reference circuit 10 from output node 22. However, switch transistors M1 and M2 are turned on, which passes Vref2 to output 22. It is noted that though signals ENBGN and ENADN are shown as separate signals in embodiments in FIG. 2, one signal may suffice when their timing characteristics are identical. Regardless of whether the same or different control signals are used for the ADC 12 and bandgap reference circuit 10, the signals should adhere to the following conditions: signal ENBGN must remain low until signal Vref2 is available, whereas signal ENADN need only remain low until after the register 14 has latched data from ADC 12.

From the foregoing, it should be understood that after time T3, the bandgap reference circuit 10 is in the off state. Even though the reference circuit 10 in the off state, the circuit 50 generates a power supply and temperature independent bandgap reference voltage Vref2 at output 22 for output voltage Vref-out. Voltage Vref2 is substantially equal to voltage Vref1, with its accuracy dependent on controllable parameters such as the sampling accuracy of ADC 12 and the conversion accuracy of DAC 16. The power consumed by output stage 20 and DAC 16 from time T3 is less than the power that would be consumed by bandgap reference circuit 10 during this time. Thus, circuit 50 operates as a low power bandgap reference voltage generator, when compared to conventional reference voltage generators 10.

Though determined by the specific application and design, T0 to T1, i.e., the time for supply voltage VDD to reach steady state, will typically be from about several hundred microseconds to several milliseconds. Time T1 to T2 is set to be long enough so that bandgap reference circuit 10 can provide a steady reference voltage Vref1 and for ADC 12 to sample the voltage Vref1. Many circuits have built in detectors for determining that the power supply is stable. For example, a DRAM controller provides a number of periodic refresh commands only after it is determined that the power supply voltage is stable. All chips that operate on a stable power supply voltage generate some form of command signal representing that the power supply voltage is stable. These circuits could use the circuit 50 for providing a reference voltage, using internal control signals or derivatives thereof as the control signals for circuit 50.

Figure 3:
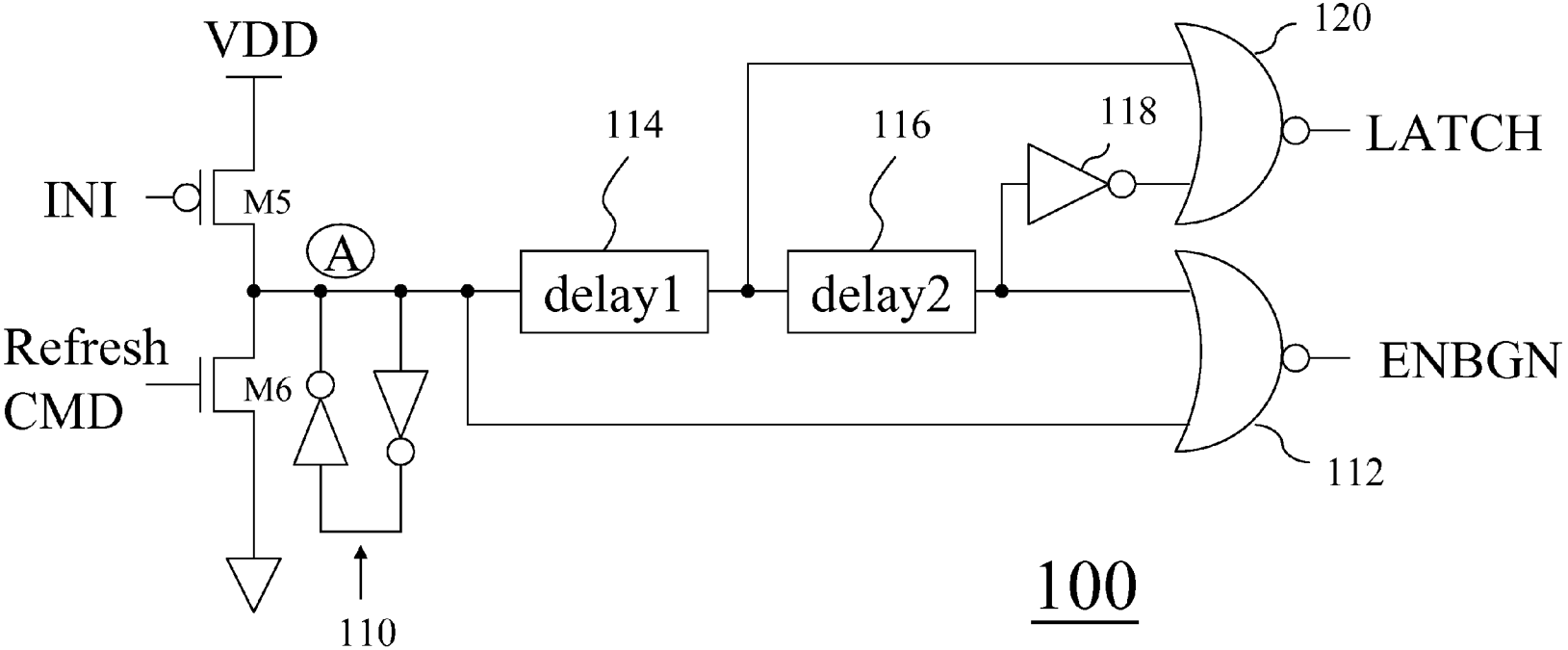
FIG. 3 is a circuit diagram of an exemplary embodiment of a circuit for providing various control signals shown in FIG. 1.

FIG. 3 is a circuit diagram of an exemplary circuit 100 for providing various control signals shown in FIG. 1 when the voltage reference circuit 50 is used to provide a reference voltage for a DRAM or other memory structure that utilizes a refresh command. The circuit 100 includes an input circuit comprising a pair of series coupled transistors, specifically NMOS transistors M5 and PMOS transistor M6 coupled together at node A between the supply voltage VDD and a second voltage node, such as ground. The circuit 100 also includes a latch circuit 110 coupled to node A including a pair of cross-coupled inverters. Node A is coupled to one input of a NOR gate 112 and to a first delay element 114. The delay element can be any element designed to provide a fixed delay, such as a chain of inverters. The output of delay element 114 is provided to the input of a second NOR gate 120 and to a second delay element 116. The output of the second delay element 116 is provided to the second input of the NOR gate 112 and to the second input of the NOR gate 120 via inverter 118. NOR gate 120 outputs signal LATCH and NOR gate 112 output signal ENBGN.

The delay from second delay element 116 is used to control the pulse width of signal LATCH. The delay from the first delay element 114 controls the start of the LATCH signal. The combined delay from the first and second delay elements 114, 116 is set to allow for sufficient time for the ADC 12 and DAC 16 to perform their operations and controls the beginning of the signal ENBGN.

Figure 4:
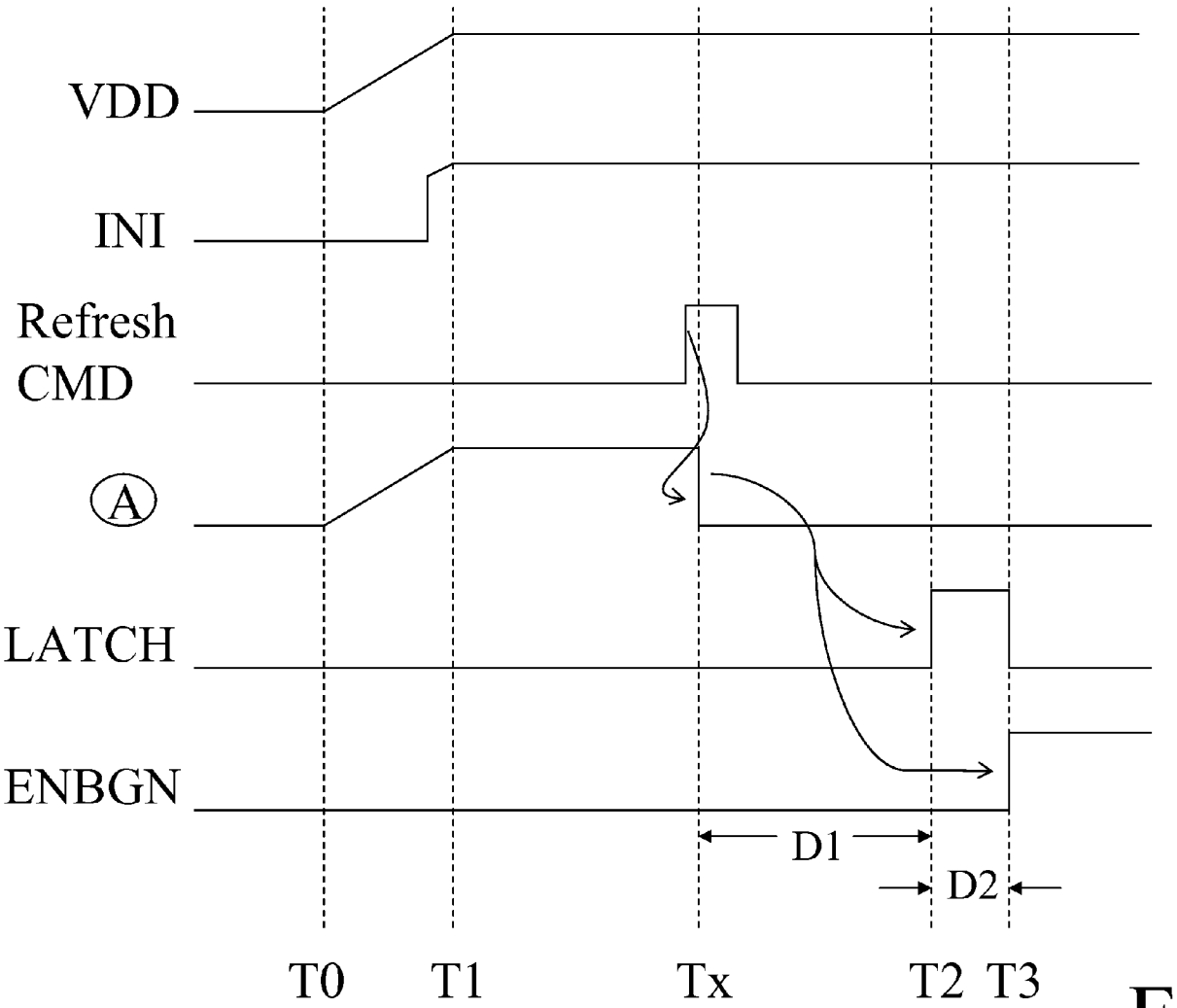
FIG. 4 is a timing diagram for various signals shown in FIG. 3.

PMOS M5 receives an "initial" signal INI at its gate terminal and NMOS M6 receives a refresh command (Refresh CMD) at its gate terminal. FIG. 4 shows a timing diagram of the various signals shown in FIG. 3. As described below, when signal INI is low, node A goes high. Node A goes low when INI is high and Refresh CMD is high.

Signal Refresh CMD is used by the DRAM circuit to trigger refresh cycles for memory cells after the DRAM power supply is stable. Therefore, this refresh command can be used as an indication that the power supply is stable. At time T0, the power supply signal VDD begins to ramp up towards its steady state. Signal INI is low along with signal Refresh CMD. With INI low and Refresh CMD low, PMOS M5 is on and NMOS M6 is off, connecting signal VDD to node A. Just before time T1, signal INI goes high, which turns off transistor M5. Latch circuit 110 samples the value at node A (which has reached VDD) and maintains that value until triggered otherwise. At time T1, VDD reaches its steady state level. After VDD reaches its steady state, sometime between time T1 and T2, a first refresh pulse signal Refresh CMD is issued by the DRAM circuit. This pulse turns NMOS M6 on briefly, forcing node A to ground at time Tx. When the pulse ends, NMOS M6 turns off but latch 110 maintains node A at ground. This low signal is provided to the first input of NOR 112 and then to the second input of NOR 112 after the combined delay (D1+D2) of delay elements 114, 116. The combined delay D1+D2 is equal to the time between time Tx and time T3. The delay D1 from delay element 114 controls the start time of signal LATCH, with the delay set by delay element 116 controlling the length of signal LATCH.

Figure 6:
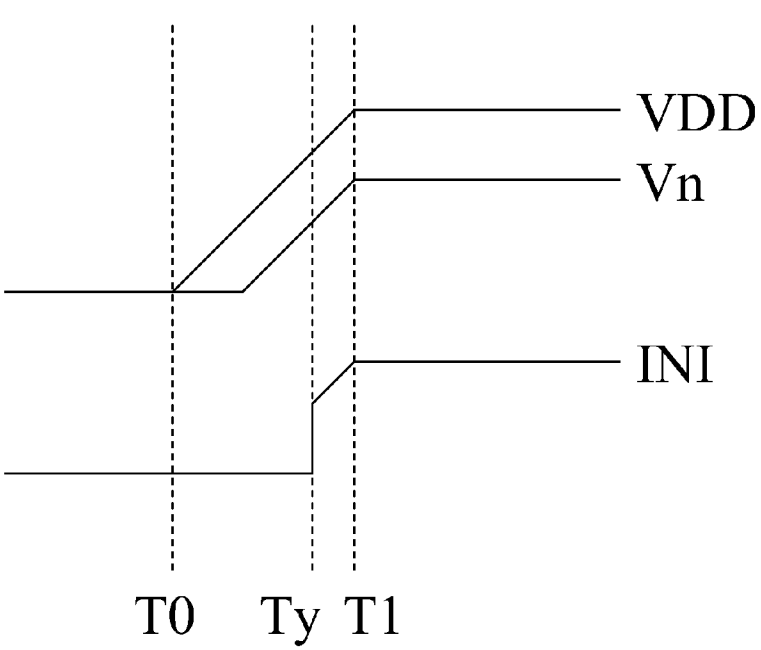
FIG. 6 is a timing diagram showing the relationship of the signals shown in FIG. 5.
Figure 5:
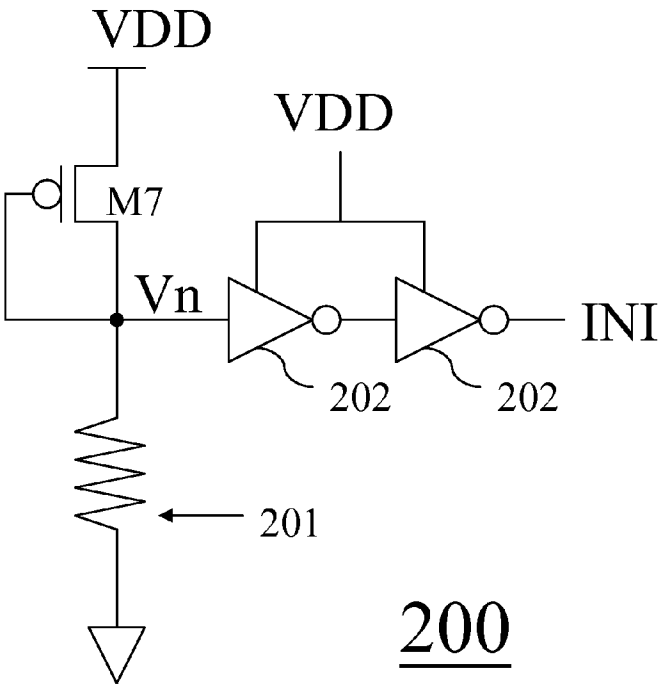
FIG. 5 is a circuit diagram of an exemplary embodiment of a circuit for providing the INI control signal shown in FIG. 3.

FIG. 5 is a circuit schematic of a circuit 200 for providing the initial signal INI. FIG. 6 is a timing diagram of the various signals shown in FIG. 5. Circuit 200 includes a PMOS transistor M7 coupled between VDD and voltage node Vn. The gate of the transistor M7 is coupled to the drain terminal, which is coupled to node M7. A resistive element 201 is coupled between the node Vn and ground. A pair of series coupled inverters 202 are coupled to node Vn to provide signal INI. Without the inverters 202, INI would equal Vn, i.e., VDD-Vth(M7). Inverters 202 are used in order to set the rising INI to VDD, i.e., INI will be raised to VDD when Vn>Vth(inverter). Turning to FIG. 6, at time T0, VDD begins to rise to its steady state voltage, which it reaches at time T1. PMOS M7 turns on at a time between time T0 and time Ty. Current begins to flow through M7 and resistive element 201. The voltage at node Vn begins to track voltage VDD at a level of VDD-Vth. The output INI remains low until time Ty when the voltage at node Vn is high enough to be recognizes as a voltage level "1" by the first inverter 202. At time T1, voltage VDD reaches its steady state level and INI stays at a logic level "1".

In accordance with the foregoing, an exemplary method of generating a reference voltage includes the steps of:

(i) turning "on" a bandgap reference circuit and providing reference voltage (Vref1) from bandgap reference circuit to the output node;

(ii) waiting for VDD to reach a stable level;

(iii) converting Vref1 to digital signal;

(iv) latching the digital signal and converting the digital signal to an analog reference voltage (Vref2);

(v) turning the bandgap reference circuit "off" and coupling Vref2 to the output node; and (vi) maintaining the output at Vref2.

The reference circuit 50 can be used in a variety of applications where a substantially constant reference voltage is desired despite fluctuations in temperature and/or power supply voltage. For example, the circuit 50 can provide a reference voltage for use by a chip's internal regulator. In another embodiment, the reference circuit 50 can provide the reference voltage for a DRAM chip.

Although the invention has been described in terms of exemplary embodiments, it is not limited thereto. Rather, the appended claims should be construed broadly to include other variants and embodiments of the invention that may be made by those skilled in the art without departing from the scope and range of equivalents of the invention.

What is claimed is:

1. A circuit for providing a reference voltage, comprising:

a bandgap reference circuit, said bandgap reference circuit providing a first reference voltage;

an analog to digital converter for providing a digital value corresponding to said first reference voltage;

a data storage, said data storage storing the digital value corresponding to said first reference voltage;

a digital to analog converter coupled to said data storage for providing a second reference voltage corresponding to said digital value; and an output switch circuit responsive to at least one control signal, said output switch circuit providing either said first reference voltage or said second reference voltage to an output node responsive to said control signal.

2. The circuit of claim 1, wherein the analog to digital converter is coupled between an output of said bandgap reference circuit and said data storage.

3. The circuit of claim 2, wherein said data storage comprises a data register responsive to a latch command.

4. The circuit of claim 1, wherein said output switch circuit comprises first and second switches responsive to said control signal, wherein said control signal is a bandgap reference circuit enable/disable signal.

5. The circuit of claim 4, wherein said first switch passes said first reference voltage to said output node when said bandgap reference circuit is enabled and said second switch passes said second reference voltage to said output node when said bandgap reference circuit is disabled.

6. The circuit of claim 5, wherein said second reference voltage becomes available at a time after said first reference voltage becomes available from said bandgap reference circuit, wherein said bandgap reference circuit enable/disable signal disables said bandgap reference circuit at a time at or after said time when said second reference voltage becomes available.

7. The circuit of claim 4, wherein said switches comprise CMOS switches.

8. The circuit of claim 1, wherein said control signal is a bandgap reference circuit enable/disable signal, said signal disabling said bandgap reference circuit after a first period of time, wherein said output node is coupled to said second reference voltage after said first period of time.

9. The circuit of claim 1, wherein said first and second reference voltages are substantially equal.

10. A low power circuit for providing a reference voltage, comprising:

a bandgap reference circuit, said bandgap reference circuit providing a first Reference voltage in response to a control signal;

an analog to digital converter coupled to an output of said bandgap reference circuit, said analog to digital converter providing a digital value corresponding to said first reference voltage;

a data register coupled to an output of said analog to digital converter, said data Register storing said digital value;

a digital to analog converter coupled to said data register, said digital to analog converter providing a second reference voltage corresponding to said digital value; and an output switch comprising a first switch coupled to said bandgap reference Circuit output and a second switch coupled to an output of said digital to analog converter, wherein said switches are responsive to said control signal to pass said first reference voltage to an output node of said low power circuit when said bandgap reference circuit is enabled and to pass said second reference voltage to said output node after said bandgap reference circuit is disabled.

11. The circuit of claim 10, wherein said first and second reference voltages are substantially equal and said second reference voltage is available from said digital to analog converter at a time after said first reference voltage becomes available from said bandgap reference circuit, and wherein said control signal disables said bandgap reference circuit at or after said time when said second reference voltage becomes available.

12. The circuit of claim 10, wherein said bandgap reference circuit operates from a power supply voltage, said supply voltage becoming stable after a first period of time, wherein said data register latches said digital value from said analog to digital converter after said first period of time.

13. The circuit of claim 12, wherein said output switches comprise CMOS switches.

14. A method of providing a reference voltage, comprising the steps of:

generating a first reference voltage with a bandgap reference circuit;

converting said first reference voltage to a digital signal;

converting said digital signal into a second reference voltage;

providing said first reference voltage to an output node for a first period of time; and after said first period of time, disabling said bandgap reference circuit and providing said second reference voltage to said output node.

15. The method of claim 14, wherein said converting said digital signal step comprises storing said digital signal and providing said stored digital signal to a digital to analog converter.

16. The method of claim 14, wherein said converting said first reference voltage step comprises providing said first reference voltage to an analog to digital converter, said method further comprising the step of disabling said analog to digital converter after said storing step.

17. The method of claim 14, wherein said first time period is long enough for a power supply from which said bandgap reference circuit operates to reach a steady state level.

* * * * *

UNITED STATES PATENT AND TRADEMARK OFFICE

CERTIFICATE OF CORRECTION

PATENT NO. : 7,443,231 B2
APPLICATION NO. : 11/463420
DATED : October 28, 2008
INVENTOR(S) : Chien-Yi Chang It is certified that error appears in the above-identified patent and that said Letters Patent is hereby corrected as shown below:

Col. 7, Line 11; delete “Reference” and substitute therefore --“reference”--
Col. 7, Line 18; delete “Register” and substitute therefore --“register”--
Col. 7, Line 23; delete “Circuit” and substitute therefore --“circuit”--

Signed and Sealed this

Sixteenth Day of December, 2008

JON W. DUDAS
*Director of the United States Patent and Trademark Office*